US010429022B2

(12) United States Patent
Haberkorn et al.

(10) Patent No.: US 10,429,022 B2
(45) Date of Patent: Oct. 1, 2019

(54) HEADLIGHT FOR A MOTOR VEHICLE

(71) Applicant: GM GLOBAL TECHNOLOGY OPERATIONS LLC, Detroit, MI (US)

(72) Inventors: Rouven Haberkorn, Ruesselsheim (DE); Justus Illium, Ruesselsheim (DE); Philipp Roeckl, Ruesselsheim (DE); Gregor Krieg, Ruesselsheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 232 days.

(21) Appl. No.: 15/361,827

(22) Filed: Nov. 28, 2016

(65) Prior Publication Data

US 2017/0152999 A1 Jun. 1, 2017

(30) Foreign Application Priority Data

Nov. 27, 2015 (DE) ..... 10 2015 015 360

(51) Int. Cl.

| | |
|---|---|
| ***F21S 41/25*** | (2018.01) |
| ***F21S 41/20*** | (2018.01) |
| ***F21S 41/43*** | (2018.01) |
| ***F21S 41/147*** | (2018.01) |
| ***F21S 41/255*** | (2018.01) |

(52) U.S. Cl.

CPC ..... *F21S 41/25* (2018.01); *F21S 41/147* (2018.01); *F21S 41/255* (2018.01); *F21S 41/285* (2018.01); *F21S 41/43* (2018.01)

(58) Field of Classification Search

CPC ..... F21S 41/147; F21S 41/25; F21S 41/255; F21S 41/285; F21S 41/43

See application file for complete search history.

(56) References Cited

U.S. PATENT DOCUMENTS

| | | | | |
|---|---|---|---|---|
| 5,681,104 | A * | 10/1997 | Chinniah | F21S 41/43 362/538 |
| 6,015,220 | A * | 1/2000 | Blusseau | F21S 41/255 362/303 |
| 9,086,202 | B2 | 7/2015 | Rottstaedt | |
| 2005/0180154 | A1* | 8/2005 | Albou | F21S 41/695 362/514 |
| 2005/0225999 | A1* | 10/2005 | Bucher | F21V 9/04 362/539 |

(Continued)

FOREIGN PATENT DOCUMENTS

| | | | |
|---|---|---|---|
| DE | 102008021520 | A1 | 11/2009 |
| DE | 102010046021 | A1 | 3/2012 |

(Continued)

OTHER PUBLICATIONS

German Patent Office, German Search Report for German Application No. 102015015360.9, dated Jun. 21, 2016.

*Primary Examiner* — Robert J May
*Assistant Examiner* — Leah Simone Macchiarolo
(74) *Attorney, Agent, or Firm* — Lorenz & Kopf, LLP

(57) ABSTRACT

A headlight for a motor vehicle includes a light source, a projection lens, an optical element that corrects a chromatic aberration of the projection lens and a screen arranged between the light source and the projection lens, on which screen the corrective optical element is mounted at a distance from the projection lens.

13 Claims, 1 Drawing Sheet

(56) References Cited

U.S. PATENT DOCUMENTS

| | | | | |
|---|---|---|---|---|
| 2005/0276062 | A1* | 12/2005 | Pauty | F21S 41/695 362/539 |
| 2009/0303741 | A1* | 12/2009 | Shih | F21S 41/17 362/539 |
| 2014/0029287 | A1 | 1/2014 | Anzai et al. | |
| 2015/0211705 | A1* | 7/2015 | Leitow | F21S 41/285 362/510 |
| 2017/0328535 | A1* | 11/2017 | Yagi | F21V 29/504 |
| 2018/0328564 | A1* | 11/2018 | Albou | B60Q 1/50 |

FOREIGN PATENT DOCUMENTS

| | | | |
|---|---|---|---|
| DE | 102014100904 | A1 | 7/2015 |
| EP | 2062775 | A1 | 5/2009 |
| EP | 2431658 | A2 | 3/2012 |

* cited by examiner

HEADLIGHT FOR A MOTOR VEHICLE

CROSS-REFERENCE TO RELATED APPLICATION

This application claims priority to German Patent Application No. 102015015360.9, filed Nov. 27, 2015, which is incorporated herein by reference in its entirety.

TECHNICAL FIELD

The present disclosure pertains to a headlight for a motor vehicle configured to suppress a color fringe at a cut-off of a light distribution of the headlight.

BACKGROUND

Such a color fringe is attributed to chromatic aberration, a known image defect in optical systems, which is associated with the dependence of the refractive index of the optical materials on the wavelength of the light passing through. In imaging optical systems such as microscopes, telescopes and cameras, achromatic elements or apochromatic elements have long been used to suppress chromatic aberration. These elements are lens systems in which the materials of several lenses mounted closely one behind the other complement each other in such a manner that the lens system has exactly corresponding focal lengths at two or three wavelengths of the visible spectrum.

Little attention has been paid so far to chromatic aberration in the design of headlights, since the conventionally used filament light sources have a continuously decreasing brightness at their edges and chromatic aberration is hardly visible at the edges of the light cone projected with the aid thereof. However, a chromatic dispersion becomes visible in this case at the edge of a screen that blocks some of the light flux.

A vehicle headlight in which an achromatic element is used to suppress a color fringe at a screen edge is known from DE 10 2010 046 626 A1. In the achromatic element, a projection lens, a diffuser lens and an interstice filled with a transparent medium are connected to form a structural unit. The interstice simplifies the manufacture of the lenses of the achromatic element, since the lens surfaces that face each other do not have to have exactly the same curvatures. On the other hand, the assembly thereof is made more complicated, since the lenses must be supported independently of each other and the interstice between them must be sealed.

Accordingly, there is a need to provide a vehicle headlight with correction of the chromatic aberration that is cost-effective and simple to manufacture.

SUMMARY

The present disclosure provides a headlight for a motor vehicle having a light source, a projection lens, an optical element that corrects a chromatic aberration of the projection lens and a screen arranged between the light source and the projection lens. The corrective optical element is mounted on the screen at a distance from the projection lens. The corrective optical element may include a flint glass. For reasons of weight and manufacturing technology, a transparent plastic, in particular polycarbonate, is preferred as the material for the corrective optical element. Correspondingly, the projection lens may include a crown glass or a second transparent plastic such as polymethylmethacrylate.

If the corrective optical element is manufactured from plastic as mentioned above, the optical element and the screen can be injection-molded to each other. This allows both cost-effective and precise manufacture of the assembly composed of screen and corrective optical element. The screen may include a shoulder that extends in the direction of the optical axis of the projection lens, on which shoulder the corrective optical element is attached. This allows the corrective optical element to be attached both by injection-molding and in another way, for instance by adhesive bonding.

According to a further alternative, the corrective optical element can be applied in the form of a film to a transparent plate through which the light source shines and which is formed integrally with the screen. According to a further simplification, the corrective optical element as such is produced integrally with the screen.

According to the latter alternative, the screen may include an opaque layer, which is arranged on a transparent carrier material or is embedded in a transparent carrier material. The carrier material can then also form the transparent plate or the corrective optical element. A diffuser lens may be used as the corrective optical element.

High-precision correction of the chromatic dispersion together with a reduction in weight is possible with a micro-structured diffractive optical element as the corrective optical element.

If a reflector is arranged to deflect light of the light source onto the projection lens and a focal point of the reflector lies between the reflector and the projection lens, the corrective optical element that is arranged between the light source and the projection lens can advantageously have smaller dimensions than the projection lens.

At least one LED should be provided as the light source of the headlight, since the relatively low heat generation thereof makes it easier to use plastics for the screen and the corrective optical element.

BRIEF DESCRIPTION OF DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
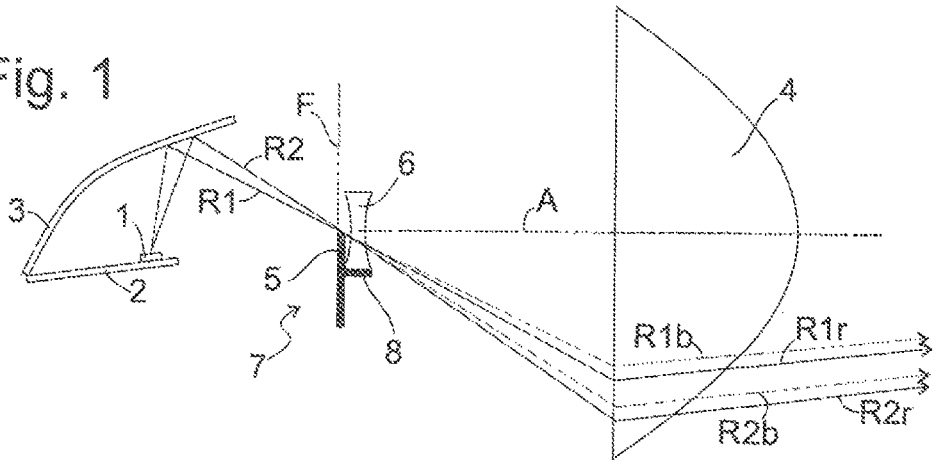
FIG. 1 shows a schematic longitudinal section through a vehicle headlight according to a first configuration of the present disclosure.

The headlight shown in longitudinal section in FIG. 1 includes a white-light LED as the light source 1, which is mounted on a carrier 2 oriented approximately horizontally and dissipates waste heat from the light source 1. The light source 1 emits in the direction of the surface normal thereof, substantially upwards, against a concave reflector 3. The reflector 3 deflects the light forward, in the direction of a projection lens 4, and in the process, creates an image of the light source in an image plane IP inside the headlight. In the image plane F lie a screen 5 and the focal point of a lens system formed by the projection lens 4 and a diffuser lens 6, so that the contour of the screen 5 is projected sharply into the distance by the lens system and a light cone is produced that avoids dazzling oncoming traffic thanks to a sharp upper boundary.

FIG. 1 shows, in a highly exaggerated manner, using two beams R1, R2 emanating from the light source 1, chromatic splitting in the diffuser lens, which results in the long-wave fraction R1*r* and R2*r* (shown with solid lines) being incident on the projection lens 4 at a greater distance from the optical axis A than the short-wave fraction R1*b*, R2*b* (shown with dashed lines). At the projection lens 4, the increased distance of the long-wave fraction from the optical axis A means that the anile between the surfaces at the points on the front and rear sides of the projection lens 4 through which the long-wave fraction R1*r* and R2*r* passes is greater than the corresponding angle at the points through which the short-wave fraction Rib and R2*b* passes. The larger angle in turn results in the long-wave fraction being deflected more than the short-wave fraction, so that both propagate in parallel on the other side of the projection lens 4.

In the configuration of FIG. 1, the screen 5 has the shape of a plate that includes an opaque material such as a dyed plastic and is located perpendicularly on the optical axis A of the lens system, the lower edge of which is configured to be anchored on a housing of the headlight and the upper edge of which defines an upper edge of the dipped or full-beam light cone in the beam of the headlight on the other side of the projection lens 4. The screen 5 and the diffuser lens 6 form a screen assembly 7 in that the diffuser lens 6 is mounted on a shoulder 8, which projects from the plate in the direction of the optical axis A of the lens system, between the image plane F and the projection lens 4. The diffuser lens 6 is connected to the projection lens 4 only indirectly, via the screen 5 and the housing of the headlight. The diffuser lens 6 may include glass, in particular flint glass, and be fastened to the screen 5 by adhesive bonding. If the diffuser lens 6 and the screen 5 are manufactured from plastic, fastening the diffuser lens 6 to the screen by welding, in particular ultrasonic welding, can also be employed.

Figure 2:
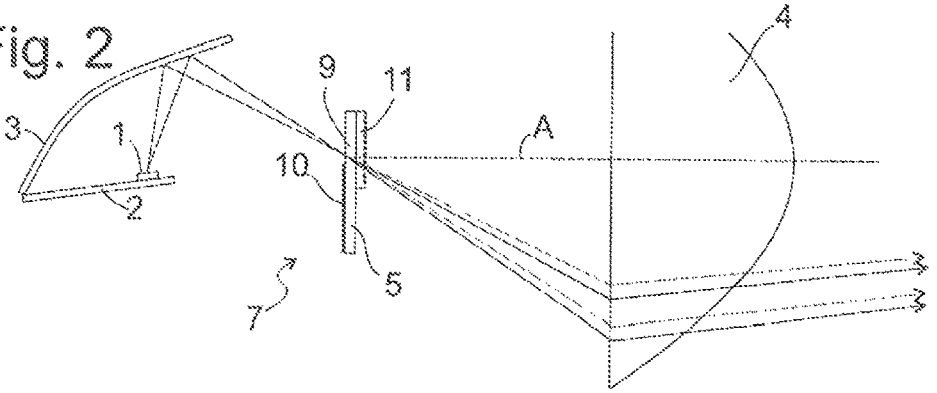
FIG. 2 shows a schematic longitudinal section through a vehicle headlight according to a second configuration of the present disclosure.

The configuration of FIG. 2 differs from that shown in FIG. 1 only by the structure of the screen assembly 7. In this case the screen assembly includes a plate 9 of transparent plastic, preferably polycarbonate, a part of which forms the screen 5 in that it is provided with an opaque, preferably reflective coating 10 on its side that faces the light source 1 and lies in the image plane F. The coating 10 may include an aluminum composition. To protect its reflectiveness, the reflective coating 10 can in turn be coated with a coating of transparent plastic or can be embedded in the transparent plastic in the manner of the data carrier foil of a compact disc or CD.

A region of the plate 9 that is free of the coating 10 intersects the path of the light from the reflector 3 to the projection lens 4. A diffractive optical element 11 is attached to the side of said free region that faces away from the reflector 3, between the image plane F and the projection lens 4. The diffractive optical element 11 is in this case a film of transparent plastic, in which micro-structures are formed by photolithographic process, which shape the wave front of the light passing through with locally differing layer thicknesses or refractive indices. The diffractive optical element 11 can substantially have the refractive behavior of a diffuser lens.

Figure 3:
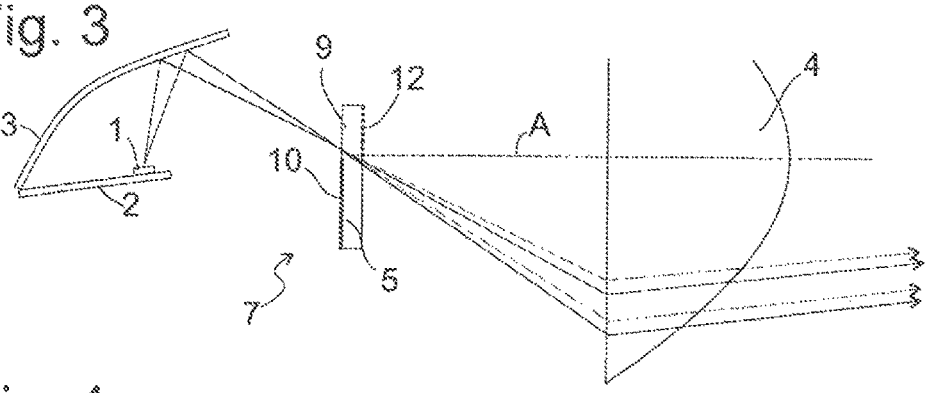
FIG. 3 shows a schematic longitudinal section through a vehicle headlight according to a third configuration of the present disclosure.

According to the configuration shown in FIG. 3, the core of the screen assembly 7 is, as in FIG. 2, a plate 9 of transparent plastic, of which a part that forms the screen 5 is provided with an opaque coating 10 on its side facing the light source 1. A diffractive optical element 12 is formed directly in the surface of the plate 9 that faces the projection lens 4.

Figure 4:
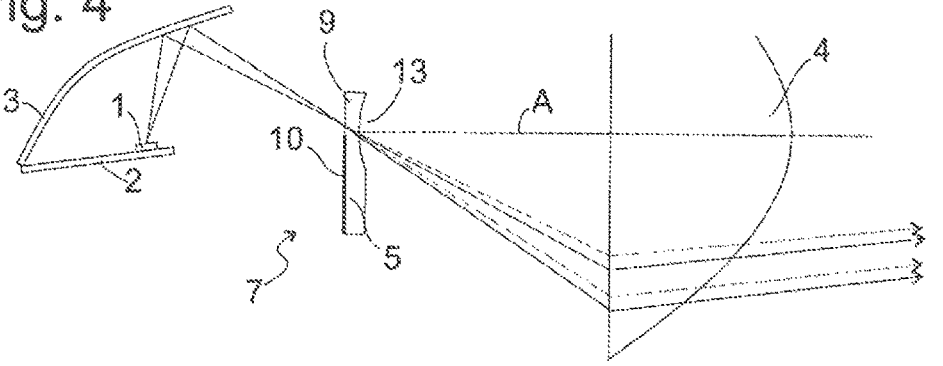
FIG. 4 shows a schematic longitudinal section through a vehicle headlight according to a fourth configuration of the present disclosure.

According to the configuration of FIG. 4, a diffuser lens 13 is injection-molded integrally with the plate 9 of transparent plastic. The opaque coating 10 of the screen 5 is obtained by laying an opaque in-mold decoration foil in the injection mold of the plate 8.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A headlight for a motor vehicle, comprising:

a light source mounted on a horizontal carrier;

a reflector adjacent to the carrier and the light source emits in a direction of a surface normal of the carrier upwards against the reflector;

a projection lens that receives light deflected by the reflector;

a corrective optical element that corrects a chromatic aberration of the projection lens; and a screen arranged between the light source and the projection lens, wherein the corrective optical element is mounted on a first side of the screen that faces away from the reflector and at a distance from the projection lens.

2. The headlight according to claim 1, wherein the corrective optical element comprises a transparent plastic element.

3. The headlight according to claim 2, wherein the transparent plastic element comprises a polycarbonate element.

4. The headlight according to claim 1, wherein the corrective optical element and the screen are injection-molded onto each.

5. The headlight according to claim 1, wherein the screen has a shoulder that extends in the direction of the optical axis of the projection lens to which the corrective optical element is attached.

6. The headlight according to claim 1, wherein the screen comprises a transparent plate through which the light source shines and on which the corrective optical element is attached.

7. The headlight according to claim 6, wherein the screen has a first end opposite a second end, the first side opposite a second side, the second side faces the reflector and the first side faces the projection lens, the screen comprises a transparent carrier material having an opaque reflective coating that extends from the first end toward the second end to define a region on the screen that is free of the reflective coating and the corrective optical element is mounted on the region.

8. The headlight according to claim 1, wherein the corrective optical element is integral with the screen.

9. The headlight according to claim 8, wherein the screen has a first end opposite a second end, the first side opposite a second side, the second side faces the reflector and the first side faces the projection lens, the screen comprises a transparent carrier material having an opaque reflective coating that extends from the first end toward the second end to define a region on the screen that is free of the reflective coating and the corrective optical element is mounted on the region.

10. The headlight according to claim 1, wherein the corrective optical element comprises a diffuser lens.

11. The headlight according to claim 1, wherein the corrective optical element comprises a micro-structured diffractive optical element.

12. The headlight according to claim 1, wherein the light source comprises at least one LED.

13. A headlight for a motor vehicle, comprising:

a light source mounted on a horizontal carrier;

a reflector adjacent to the carrier and the light source emits in a direction of a surface normal of the carrier upwards against the reflector;

a projection lens that receives light deflected by the reflector;

a corrective optical element that corrects a chromatic aberration of the projection lens; and a screen arranged between the light source and the projection lens, the screen having a first side opposite a second side, a first end opposite a second end, the second side faces the reflector and the first side faces the projection lens, the screen including a reflective coating on the first side that extends from the first end toward the second end to define a region on the screen that is free of the reflective coating, wherein the corrective optical element is mounted in the region and on the first side of the screen, and is at a distance from the projection lens.

* * * * *